US009303418B2

(12) United States Patent
Schwoerer

(10) Patent No.: US 9,303,418 B2
(45) Date of Patent: Apr. 5, 2016

(54) CLIMBING CYLINDER OF SELF-CLIMBING FORMWORK

(71) Applicant: Peri GmbH, Weissenhorn (DE)

(72) Inventor: Artur Schwoerer, Senden (DE)

(73) Assignee: Peri GmbH, Weissenhorn (DE)

( * ) Notice: Subject to any disclaimer, the term of this patent is extended or adjusted under 35 U.S.C. 154(b) by 0 days.

(21) Appl. No.: 14/578,538

(22) Filed: Dec. 22, 2014

(65) Prior Publication Data

US 2015/0101887 A1 Apr. 16, 2015

Related U.S. Application Data

(63) Continuation of application No. 11/993,023, filed as application No. PCT/DE2006/001043 on Jun. 20, 2006.

(30) Foreign Application Priority Data

Jun. 29, 2005 (DE) ..... 10 2005 030 335

(51) Int. Cl.

| | |
|---|---|
| ***E04G 11/28*** | (2006.01) |
| ***E04G 11/24*** | (2006.01) |
| ***E04G 3/20*** | (2006.01) |
| *E04G 3/28* | (2006.01) |

(52) U.S. Cl.

CPC *E04G 11/28* (2013.01); *E04G 3/20* (2013.01); *E04G 11/24* (2013.01); *E04G 2003/286* (2013.01)

(58) Field of Classification Search

CPC ..... E04G 11/28; E04G 11/20; E04G 11/24; E04G 3/20; E04G 2003/286

USPC ..... 249/18–22; 425/63, 65; 264/33; 182/2.1–2.3

See application file for complete search history.

(56) References Cited

U.S. PATENT DOCUMENTS

| | | | | |
|---|---|---|---|---|
| 4,040,774 | A * | 8/1977 | Scheller | 425/65 |
| 4,962,828 | A * | 10/1990 | Duncan | 182/82 |
| 7,581,709 | B2 * | 9/2009 | Gillespie et al. | 249/19 |
| 2003/0052249 | A1 * | 3/2003 | Waldschmitt et al. | 249/20 |
| 2005/0217934 | A1 * | 10/2005 | Choo | 182/82 |
| 2007/0119116 | A1 * | 5/2007 | Arozena Bergaretxe et al. | 52/633 |

FOREIGN PATENT DOCUMENTS

| | | | | |
|---|---|---|---|---|
| EP | 34819 A2 * | 9/1981 | | E04G 3/04 |
| WO | WO 2004020766 A1 * | 3/2004 | | E04G 21/32 |

* cited by examiner

*Primary Examiner* — Daniel Cahn
(74) *Attorney, Agent, or Firm* — Paul Vincent

(57) ABSTRACT

A self-climbing formwork has a stationary climbing shoe (18) structured for attachment to a wall anchor point and a climbing cylinder (10) having a lower end directly contacting the climbing shoe (18) to form a hinge, the hinge defining a pivoting movement of the climbing cylinder (10) relative to the climbing shoe (18). A support (30) is provided on an upper end of the climbing cylinder (10), the support (30) having a protrusion defining a U-shaped recess. A climbing rail (22) is structured to be held in position by the climbing shoe (18) relative to the anchor point and guided along the wall through cooperation with the climbing shoe (18). Upon extension of the climbing cylinder (10), the support (30) engages beneath an upper engagement point (24", 24") of the climbing rail (22) at the U-shaped recess to urge the climbing rail (22) in an upward direction.

3 Claims, 3 Drawing Sheets

CLIMBING CYLINDER OF SELF-CLIMBING FORMWORK

This application is a continuation of Ser. No. 11/993,023 filed Dec. 19, 2007 as the national stage of PCT/DE2006/001043 filed on Jun. 20, 2006 and also claims Paris Convention priority from DE 10 2005 030 335.8 filed Jun. 29, 2005, the entire disclosures of which are hereby incorporated by reference.

BACKGROUND OF THE INVENTION

The invention relates to a self-climbing formwork and/or a self-climbing scaffold unit with a climbing cylinder which is provided for raising or lowering a formwork and/or a scaffold unit along a wall of a building.

Self-climbing formworks are known wherein the lift cylinders are affixed to climbing rails which run along a wall during a climbing process.

DE 21 54 188 A1 discloses and describes a device for concreting pillars. A pillar is concreted in a formwork which is surrounded by scaffolding. The formwork is moved along the individual pillar sections by means of a climbing cylinder. At its lower end the climbing cylinder is fixed by means of a pressure plate on a pillar section which has already hardened. At its upper end the climbing cylinder is provided with two opposed pressure ribs which are pivotally mounted and in this way can be moved past cross members of the scaffolding. During a lifting movement of the climbing cylinder, the pivoted-out pressure ribs engage in recesses on the scaffolding and abut against the cross members of the scaffolding.

It is the object of the invention to construct a climbing cylinder on a self-climbing formwork or on a self-climbing scaffold unit in such a manner that it can be used and also shifted more easily.

SUMMARY OF THE INVENTION

The object is achieved according to the invention by the features of the independent claim.

Commercially available lift cylinders which operate and are embodied for example as hydraulically operating lift cylinders can be used as climbing cylinders. The lift cylinders only need to be adapted to the invention at their respective free ends whereby at one end, a fixing connection is provided at one fixed anchor point of the wall and at the other end, a support is provided at the free end of the piston of the lift cylinder, which can engage in bearing bolts of the climbing rails at any points of the climbing rails. The climbing rails can carry formwork, platforms and any other bracing which can be raised or lowered with the climbing rails by means of the climbing cylinder or cylinders. The climbing rails can also be integrated in a scaffold unit which can receive and carry formwork in addition to other units. When a lowering or raising process has been completed by means of the climbing cylinder or cylinders, the climbing cylinder or cylinders can be shifted to other anchor points for a new movement process of the climbing rails.

The climbing cylinder or cylinders are placed at locating points formed on the climbing shoe or shoes. Consequently, always the same fastening points on the climbing shoe or shoes and the climbing cylinder or cylinders are used for holding the climbing cylinder or cylinders on the climbing shoe or shoes. The climbing system can thus have a simple structure and any scope for incorrect connection for a fixed mounting of the climbing cylinder is eliminated. When the climbing cylinders are placed on the climbing shoes, the climbing cylinder or cylinders are supported on the climbing shoe or shoes during a lifting process.

In a preferred embodiment of the invention, the climbing cylinder or cylinders are affixed to a climbing shoe or shoes which are attached to the wall in a fixed position. This has the advantage that the climbing cylinder or cylinders can always be attached at the same fixing points of climbing shoes which are fixed to the wall at the anchor points provided. An anchor point thus bears the climbing shoe which guides the climbing rails along the wall at a defined distance and can at the same time hold the climbing rail permanently in one position. The climbing cylinder uses the climbing shoe as a fixed bearing and the climbing cylinder can raise or lower the climbing rail by means of a piston stroke.

In a further embodiment, the climbing cylinder or cylinders are pivotally hinged at the fixed fixing, namely the anchor point or the climbing shoe. This has the advantage that when the piston is withdrawn into the housing of the climbing cylinder, the climbing cylinder can be pivoted out of engagement with the bearing bolts of the climbing rail, whereby when the piston retracts into the housing of the climbing cylinder, a bearing bolt impinging upon the catch of the climbing cylinder pivots the climbing cylinder to such an extent that the piston can be retracted into the housing of the climbing cylinder without any interference.

If, in this connection, the climbing cylinder is fixed in a spring-mounted manner at the anchor point and/or the climbing shoe, it can automatically pivot back into its initial position as soon as the free end of the climbing cylinder is no longer in contact with a bearing bolt.

The support of the climbing cylinder at the free end is advantageously embodied as a catch, as already stated, which can be brought into engagement with a bearing bolt of the climbing rail in a particularly simple manner. It is likewise simple to release the bearing connection between the catch and the bearing bolt by retracting the piston into the housing of the climbing cylinder. The catch is non-pivotally hinged to the piston and at the same time, at the support, in this case the catch, a mounting plate is provided as a counterbearing for abutment against the respective climbing rail. This has the advantage that no moments from the bearing load of the climbing rail are introduced into the piston rod when the climbing cylinder raises or lowers a climbing rail.

It is understood that the spacing of the bearing bolts at the climbing rail or rails is matched to the possible piston stroke of a climbing cylinder. The piston path of a climbing cylinder is always longer than the spacing of adjacent bearing bolts on a climbing rail. A climbing cylinder must always be able to retract its piston rod with the catch hinged thereon to such an extent that the catch can automatically pivot into a position in which the catch can reliably grasp below a bearing bolt of the climbing rail. When a climbing process has been completed, the climbing cylinder or cylinders are moved to adjacent anchor points or climbing shoes so that another climbing process can be carried out after another concreting section has been completed. The climbing cylinder can be moved together with hydraulic hoses connected to the climbing cylinders or the climbing cylinders are uncoupled from the hydraulic hoses by means of quick connectors for the process of shifting to other fixed mounting points. After the climbing cylinder has been replaced, the hydraulic connection between the climbing cylinder and a hydraulic unit is made again.

In one exemplary embodiment the following figures show a section of a wall on which a climbing cylinder is fixed which holds a rail to which various attachments can be fixed.

It is understood that the bearing bolts of the climbing rails can also be replaced by technically equivalent means. Thus, matched catches or supports of a sliding shoe can also engage in through openings on the climbing rails or projections can be constructed on the climbing rails which can be gripped or grasped from below by corresponding supports of the sliding shoe.

In the figures:

DESCRIPTION OF THE PREFERRED EMBODIMENT

Figure 1:
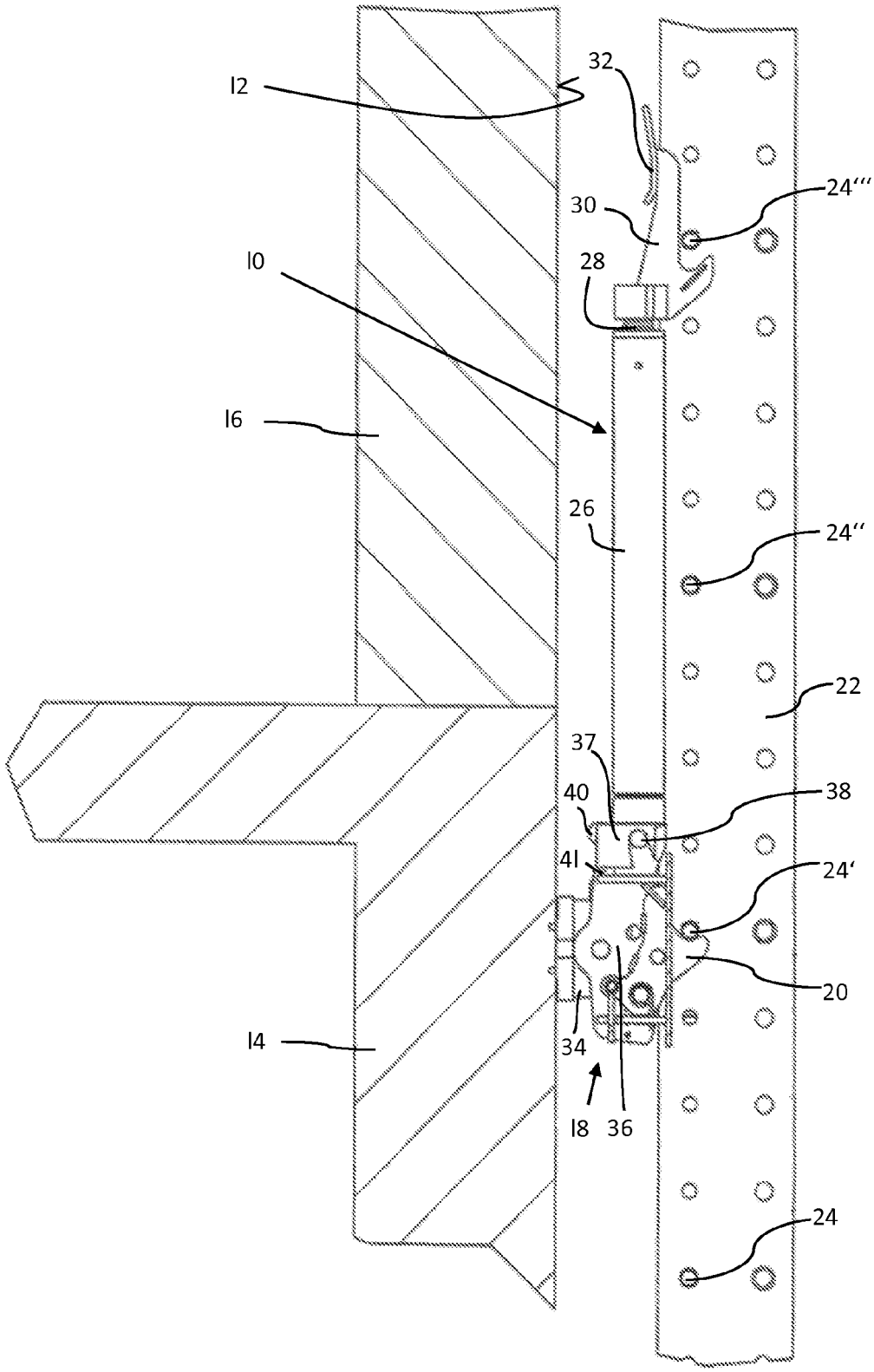
FIG. 1 shows a climbing cylinder of a self-climbing formwork according to the invention in side view on a wall consisting of a first and a second concreting section.

The figures in the drawings show the climbing cylinder according to the invention and the associated parts highly schematically so that the structure and the operating mode of the climbing cylinder can be clearly shown.

FIG. 1 shows a climbing cylinder 10 in the retracted state as attached to a wall 12 of a building. The figure shows sections of a first concreting section 14 and a second concreting section 16. A climbing shoe 18 is fixed on an anchor point on the first concreting section 14 in a fixed position. The climbing shoe 18 guides and holds a climbing rail 22 in position by means of a catch 20. At points of the first and/or the second concreting section 14, 16 not shown there is provided at least one further climbing shoe which together with the climbing shoe 18 shown holds the climbing rail 22 guided on the wall 12.

The catch 20 of the climbing shoe 18 can grasp under the bearing bolts 24, 24', 24", 24" according to the position of the climbing rail 22. In the position shown in the figure the catch 20 grasps under the bolt 24' so that the climbing rail 22 is held against its gravitational force on the wall 12 so that it cannot be displaced.

The climbing cylinder 10 has a housing 26 in which a piston 28 is guided so that it can be displaced hydraulically. Hinged at the free end of the piston 28 is a support 30 on which a mounting plate 32 is provided. The support 30 has an opening suitable for receiving a bearing bolt 24 to 24'". In the retracted state of the piston 28 the support 30 is located so far under the bearing bolts 24 to 24'" that it can be pivoted without any interference into a position suitable for grasping below a bearing bolt 24 to 24'".

The climbing shoe 18 is constructed in two parts as a wall shoe 34 and sliding shoe 36. The wall shoe 34 is fixed in position at an anchor point of the wall 12 and the sliding shoe 36 is fixed in a hinged manner on the wall shoe 34. The catch 20 is pivotally mounted in the sliding shoe 36 such that it locks in the position shown in the figure and if a pressure is exerted on the opposite side of the catch which has a sloping section, the catch 20 can pivot so far into the housing of the sliding shoe 36 that it is no longer in engagement with the bearing bolts 24 to 24'".

The climbing cylinder 10 has a housing 37 by which means the climbing cylinder 10 can be placed on a shaft 38 of the sliding shoe 36. When the climbing cylinder 10 is placed on the shaft 38 by means of the housing 37, a safety bolt 40 secures the articulated connection and the climbing cylinder 10 can only be removed from the shaft 38 by unlocking the safety bolt 40, and withdrawing it. The climbing cylinder 10 can be pivoted about the shaft 38 when it is placed thereon. Between a mounting plate of the sliding shoe 36 and the housing 37 there is provided on the housing 37 a rubber or toughened element 41 which presses the climbing cylinder 10 into the position shown in the figure. If the piston 28 of the hydraulically operated climbing cylinder is extended, the support 30 engages beneath the bearing bolt 24'" and during a further extension of the piston 28, the climbing rail 22 is raised.

Figure 2:
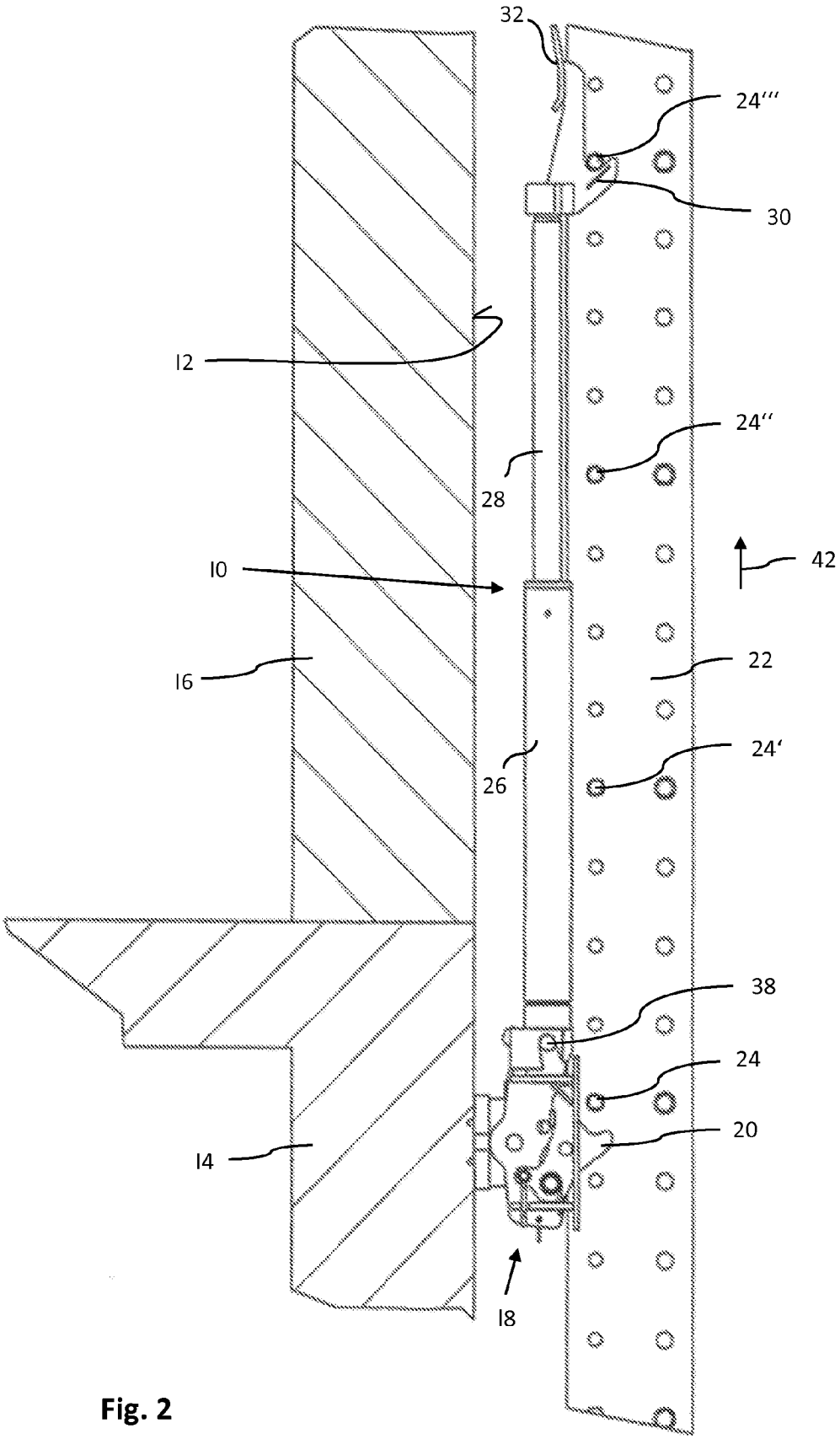
FIG. 2 shows a further side view to FIG. 1 with the climbing cylinder according to the invention in the extended state.

FIG. 2 shows the climbing cylinder 10 in a fully extended position. The piston 28 is fully extended from the housing 26 and the climbing rail 22 has been raised by means of the climbing cylinder 10 in the direction of the arrow 42. The entire load of the climbing rail 22 and the associated attachments of the climbing rail 22 rest on the support or supports 30 of the climbing cylinder 10. In the position shown in the figure, the catch 20 of the climbing shoe 18 is out of engagement with the bearing bolt 24 which during raising of the climbing rail 22 in the direction of the arrow 42, has temporarily pressed the catch 20 into the climbing shoe 18 so that the lift process could be carried out in the direction of the arrow 42 without hindrance.

Compared with the position of the climbing rail 22 in FIG. 1, the climbing rail 22 in FIG. 2 has been raised by a path length whose length is determined by the distance of the catch 20 from the bearing bolt 24'. During the lifting process the climbing cylinder 10 is supported on the shaft 38 of the climbing shoe 18. By abutting against the climbing rail 22 so as to restrict the pivot path, the mounting plate 32 prevents the support 30 from being able to pivot further under load and prevents any moments from being introduced into the piston 28 of the climbing cylinder 10 under the bearing load of the support 30 by the climbing rail 22. The mounting plate 32 thus has the function of a counterbearing. By means of the lifting movement shown in FIG. 2, the climbing rail 22 climbs along the concreting sections 14, 16 in the direction of the arrow 42 and if the piston 28 is now retracted slightly, the bearing bolt 24 rests on the catch 20 and the climbing shoe 18 now bears the entire load of the climbing rail 22 by means of the catch 20. The support 30 of the climbing cylinder 10 is then relieved of weight (see FIG. 3).

Figure 3:
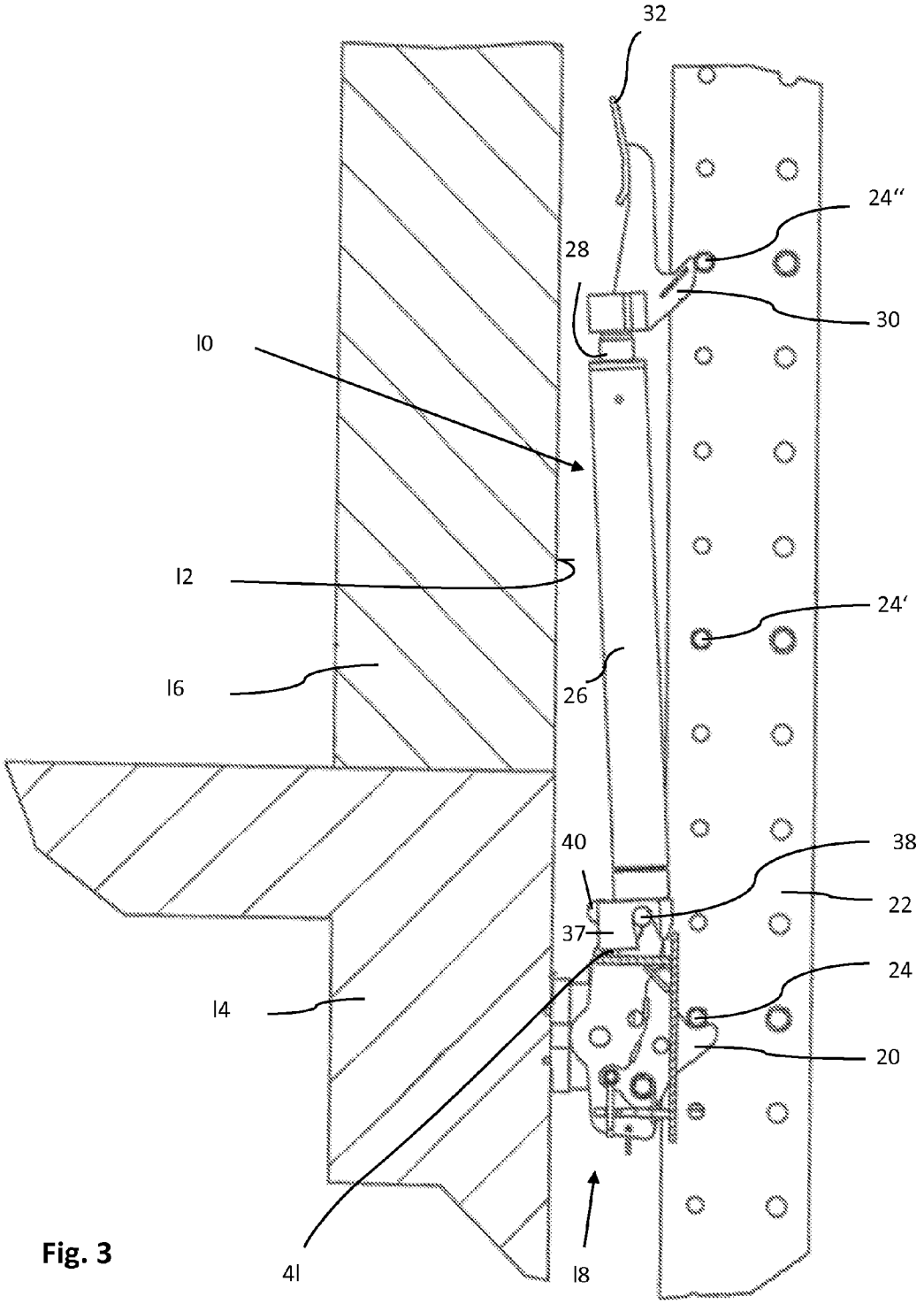
FIG. 3 shows a side view with a climbing cylinder according to the invention showing how this pivots on the fixed mounting when the piston retracts.

FIG. 3 shows the climbing cylinder 10 in the non-fully-retracted state. The piston 28 is not fully retracted into the housing 26. If the climbing cylinder 10 is now retracted further compared with the state of movement of the climbing cylinder 10 in FIG. 2, the support 30 impinges upon its lower side, which is constructed as sloping, against the bearing bolt 24". If the piston 28 is retracted further into the housing 26, the bearing bolt 24", being held at its distance from the wall 12 by means of the spaced climbing shoe 18 so that it cannot be displaced on the climbing rail 22, presses the climbing cylinder 10 out of its alignment shown in FIGS. 1 and 2 into a pivoted position as shown in FIG. 3. The climbing cylinder 10 pivots about the shaft 38 so far in the direction of the wall 12 that it can completely bypass a bearing bolt, in this case the bearing bolt 24". When the climbing cylinder 10 is pivoted, the climbing cylinder 10 is pivoted from its aligned position against a spring force produced by the rubber or toughened element 41 and if the support 30 is free from any hindrance such as the bearing bolt 24", as result of the spring force of the rubber or toughened element 41, the climbing cylinder 10 pivots back into its position free from spring loading, as shown in FIGS. 1 and 2. It is shown in FIG. 3 how the safety bolt 40 secures the hinge around the shaft 38 so that the housing 37 is securely held on the shaft 38. The piston 28 can be retracted so far into the housing 26 that the support 30 is automatically brought back into a position which can receive the bearing bolt 24" (a comparable position of the support 30 as in FIG. 1). The support 30 then comes into engagement with the bearing bolt 24" if the piston 28 is withdrawn slightly from the housing 26. The support 30 is non-pivotably mounted at said upper end of said climbing cylinder.

The spacings of the bearing bolts on the climbing rail 22 are matched to the piston stroke length of the climbing cylinder 10 so that the desired climbing strokes can be carried out. The climbing rail 22 also has other through openings which can be used for fixing bracings, platforms and formwork. The climbing rail itself is shown cut in the figures. The figures only show half of the climbing rail used here which is composed of two U-profiles and joined together at a distance by means of bearing bolts.

A climbing cylinder 10 of self-climbing formwork in the building area is provided such that it can move climbing rails 22 along a wall 12 in a vertical direction 42. At one end the climbing cylinder 10 has a fixing for an anchor point of the wall and at the other end a support 30 is provided on the climbing cylinder 10, which can be brought into engagement with the climbing rail 22 such that it can both bear as well as displace the climbing rail 22. The climbing cylinder 10 can be fixed at an anchor point of the building to which a climbing shoe 18 is attached.

Each climbing rail 22 has a first upper engagement point 24''' and a second upper engagement point 24" disposed below and at a separation from the first upper engagement point 24''' as well as a first lower engagement point 24' and a second lower engagement point 24 disposed below and at a separation from the first lower engagement point 24'. The self-climbing formwork has a first operative configuration (see FIG. 1) in which the climbing cylinder 10 is retracted and the U-shaped recess of the support 30 is disposed below the first upper engagement point 24''' of the climbing rail 22 with the first lower engagement point 24' of the climbing rail 22 seating on and supported by the climbing shoe 18. In a second operative configuration of the self-climbing formwork (see FIG. 2), the climbing cylinder 10 is extended and the U-shaped recess of the support 30 directly contacts a lower side of the first upper engagement point 24''' of the climbing rail 22 with the first lower engagement point 24' of the climbing rail 22 being lifted upwardly away from the climbing shoe 18. In a third operative configuration of the climbing formwork (see FIG. 3), the climbing cylinder 10 is once more retracted and the U-shaped recess of the support 30 is pivoted away from the second upper engagement point 24" of the climbing rail 22 with the second lower engagement point 24 of the climbing rail 22 then seating on and being supported by the climbing shoe 18.

I claim:

1. A self-climbing formwork or self-climbing scaffold unit for movement along a wall of a building, the wall having a wall anchor point to which the formwork or scaffold unit can be detachably fixed, the formwork or scaffold unit comprising:

a stationary climbing shoe structured for attachment to the wall anchor point, said climbing shoe having a horizontal shaft;

a climbing cylinder having a lower end directly contacting said shaft, said lower end and said shaft thereby forming a hinge, said hinge configured to pivot said climbing cylinder relative to said shaft, said climbing cylinder also having an upper end;

a support provided on said upper end of said climbing cylinder, said support having a protrusion defining a U-shaped recess; and a climbing rail having a first upper engagement point and a second upper engagement point disposed below and at a separation from said first upper engagement point, said climbing rail also having a first lower engagement point and a second lower engagement point disposed below and at a separation from said first lower engagement point, said climbing rail structured to be held in position by said climbing shoe relative to the anchor point and guided along the wall through cooperation with said climbing shoe, wherein, upon extending said climbing cylinder, said support engages beneath one of said upper engagement points of the climbing rail at said U-shaped recess to urge said climbing rail in an upward direction and then, upon retracting said climbing cylinder, said shaft said support disengages from one of said upper engagements points to allow pivoting of said climbing cylinder about said shaft in order to move said climbing cylinder towards the wall, the self-climbing formwork or scaffold unit having a first operative configuration in which said climbing cylinder is in a retracted position, said U-shaped recess is disposed below said first upper engagement point and said first lower engagement point is directly supported by said climbing shoe, a second operative configuration in which said climbing cylinder is in an extended position and said U-shaped recess directly contacts a lower side of said first upper engagement point in order to lift said first lower engagement point upwardly away from said climbing shoe and a third operative configuration in which said second lower engagement point is directly supported by said climbing shoe and said climbing cylinder is in a retracted position, wherein said retracted position of said third operative configuration results when said climbing cylinder has been pivoted about said horizontal shaft in order to move said U-shaped recess away from said second upper engagement point.

2. The self-climbing formwork or self-climbing scaffold unit of claim 1, wherein the climbing cylinder is secured to said climbing shoe with a safety bolt.

3. The self-climbing formwork or self-climbing scaffold unit of claim 1, wherein said support comprises a mounting plate, provided as a counter bearing for abutment against said climbing rail.

* * * * *